US011421180B2

(12) United States Patent
Sirak et al.

(10) Patent No.: US 11,421,180 B2
(45) Date of Patent: Aug. 23, 2022

(54) VEGETABLE OILS WITH IMPROVED LOW TEMPERATURE STORAGE STABILITY

(71) Applicant: Evonik Operations GmbH, Essen (DE)

(72) Inventors: Sofia Sirak, Plymouth Meeting, PA (US); Justin Langston, Kutztown, PA (US); Gabriel Walkup, Elkins Park, PA (US); Thomas McGregor, Trevose, PA (US); Benjamin McFadden, Gettysburg, PA (US)

(73) Assignee: Evonik Operations GmbH, Essen (DE)

( * ) Notice: Subject to any disclaimer, the term of this patent is extended or adjusted under 35 U.S.C. 154(b) by 0 days.

(21) Appl. No.: 16/965,666

(22) PCT Filed: Feb. 5, 2019

(86) PCT No.: PCT/EP2019/052698

§ 371 (c)(1),
(2) Date: Jul. 29, 2020

(87) PCT Pub. No.: WO2019/154775

PCT Pub. Date: Aug. 15, 2019

(65) Prior Publication Data

US 2020/0354646 A1 Nov. 12, 2020

Related U.S. Application Data

(60) Provisional application No. 62/627,323, filed on Feb. 7, 2018.

(30) Foreign Application Priority Data

Apr. 19, 2018 (EP) ..... 18168217

(51) Int. Cl.

| | |
|---|---|
| ***C10M 145/14*** | (2006.01) |
| ***C09K 5/00*** | (2006.01) |
| ***C10M 169/04*** | (2006.01) |
| *C10N 20/02* | (2006.01) |
| *C10N 20/04* | (2006.01) |

(52) U.S. Cl.

CPC .. *C10M 169/041* (2013.01); *C10M 2207/401* (2013.01); *C10M 2209/084* (2013.01); *C10N 2020/02* (2013.01); *C10N 2020/04* (2013.01)

(58) Field of Classification Search

CPC ..... C10M 169/041; C10M 2207/401; C10M 2209/084; C10N 2020/02; C10N 2020/04; C10N 2030/08

USPC ..... 252/79; 508/216

See application file for complete search history.

(56) References Cited

U.S. PATENT DOCUMENTS

| | | | | |
|---|---|---|---|---|
| 4,200,509 | A | 4/1980 | Seguine | |
| 5,696,066 | A | 12/1997 | Kinker et al. | |
| 5,958,851 | A * | 9/1999 | Cannon | C10M 129/14 252/570 |
| 8,801,975 | B2 | 8/2014 | Rapp et al. | |
| 2008/0178522 | A1 | 7/2008 | Siggelkow et al. | |
| 2015/0232783 | A1* | 8/2015 | Gokhale | C10L 1/143 508/467 |
| 2016/0040087 | A1* | 2/2016 | Jeon | C10M 105/24 508/463 |
| 2018/0201864 | A1 | 7/2018 | Kida et al. | |
| 2021/0076686 | A1 | 3/2021 | Li et al. | |
| 2021/0145011 | A1 | 5/2021 | Li et al. | |

FOREIGN PATENT DOCUMENTS

| | | |
|---|---|---|
| GB | 2331761 | 6/1999 |
| WO | 2017/038734 A1 | 3/2017 |

OTHER PUBLICATIONS

International Search Report dated Apr. 25, 2019 in PCT/EP2019/052698 (4 pages).
Wieber et al., U.S. Appl. No. 16/958,236, filed Jun. 26, 2020.
Wieber et al., U.S. Appl. No. 16/962,268, filed Jul. 15, 2020.
Written Opinion dated Apr. 25, 2019 in PCT/EP2019/052698 (7 pages).

* cited by examiner

*Primary Examiner* — Prem C Singh
*Assistant Examiner* — Francis C Campanell
(74) *Attorney, Agent, or Firm* — Taylor English Duma LLP; Philip P. McCann

(57) ABSTRACT

The invention relates to oil formulation comprising $C_{16-20}$ oils being stabilized for low temperature storage and preparation processes thereof. The invention also relates to the preparation of specific polymer compounds and their use as stabilizers for low temperature storage of $C_{16-20}$ oils.

21 Claims, No Drawings

VEGETABLE OILS WITH IMPROVED LOW TEMPERATURE STORAGE STABILITY

CROSS REFERENCE TO RELATED APPLICATIONS

This application is a 35 U.S.C. § 371 U.S. national phase entry of International Application No. PCT/EP2019/052698 having an international filing date of Feb. 5, 2019, which claims the benefit of European Application No. 18168217.0 filed Apr. 19, 2018 and U.S. Provisional Application No. 62/627,323 filed Feb. 7, 2018, each of which is incorporated herein by reference in its entirety.

FIELD

The invention relates to oil formulations comprising $C_{16-20}$ oils being stabilized for low temperature storage and preparation processes thereof. The invention also relates to the preparation of specific polymer compounds and their use as stabilizer for low temperature storage of $C_{16-20}$ oils.

BACKGROUND

The invention relates to a polymer that extends the low temperature storage stability of a vegetable oil containing saturated C14 or greater fatty acids. Vegetable oils are used in a wide variety of applications because of their renewability, low toxicity, and environmental friendliness. Many oils are also specifically collected because they contain other natural products that provide medicinal, therapeutic, or agricultural use. However, many of these vegetable oils have the disadvantage that they will crystallize and become solid near ambient temperatures. This crystallization occurs because the oils contain large quantities of saturated C14 or greater fatty acids. Some pure vegetable oils or dilutions may be received as liquids, but will solidify or crystallize if temporarily exposed to colder temperatures. In order for the oils to become liquid again, they must be heated to temperatures high enough to melt the waxy solid. Vegetable oils that will crystallize quickly and easily when exposed to lower temperatures are known to have poor low temperature stability.

Oils that have inherently poor low temperature stability and have crystallized during transport or storage must undergo extra treatment such as mixing, heating, and/or dilution to melt the oil for use. These processing steps cause unwanted costs and additional working time for the user. Vegetable oils can also undergo further processing such as clarification or de-waxing in order to lower the oil's crystallization point to keep the oil liquid at a broader temperature range. Clarification or dewaxing, however, alter the composition of the oil by removing some substances and waxy compounds. Additional treatments include the addition of clarifying agents, addition of processing aids, extraction with large volumes of solvent, and/or exposure to high temperatures. Even though the final product will have an improved low temperature stability, the oil and its important natural products could have been changed, reduced, or lost.

GB2331761 describes mixtures of heavy cut methyl esters containing polyalkyl(meth)acrylate copolymers. Methyl esters can be obtained by chemically breaking down from vegetable oils or animal oils. The heavy cut methyl esters described contain about 90-95% 14-24 carbon units in each methyl ester, and have iodine values from 75 to 125. An iodine value in this range indicates a very large amount of unsaturated bonds. The highly preferred methyl esters have less than 13% saturated content. These mixtures have a lower pour point compared to straight methyl esters. Only one discrete additive with the brand name Acryloid™ EF-171 was tested, however no detail is given on its composition. There is a clear indication to use alkyl methacrylate copolymer additive having a high amount of C8 to C15 alkyl methacrylate monomers in the polymer composition, namely, preferably from about 82% to about 97.5% by weight.

U.S. Pat. No. 4,200,509 describes a method of dewaxing vegetable oils in order to improve the low temperature storage stability.

U.S. Pat. No. 8,801,975 describes a composition including a refined, bleached and deodorized rapeseed oil with improved low temperature performance. The composition comprises at least one pour point depressant in order to further improve low temperature performance.

U.S. Pat. No. 5,696,066 discloses oil compositions with improved low temperature fluidity and low temperature storage stability comprising a vegetable oil and an alkyl (meth)acrylic polymer that includes repeating units derived from a ($C_8$-$C_{15}$) alkyl (meth)acrylate monomer. The specific vegetable oils are canola oil, sunflower oil and soybean oil, all of them having a saturated $C_{16-20}$ fatty acid content lower than 10% by weight.

US 2015/232783 A1 discloses additive compositions comprising an alkyl (meth)acrylic polymer prepared from a mixture of at least two alkyl (meth)acrylic monomers to improve low temperature properties of vegetable oils. The vegetable oils are rapeseed oil and canola oil, all of them having a saturated $C_{16-20}$ fatty acid content lower than 10% by weight.

There was still the need to investigate on cold temperature stability of oils with high content of saturated $C_{16-20}$ fatty acids. Therefore, the object of the present invention was to provide a method to improve the low temperature storage stability of vegetable oils comprising from 20% to 100% by weight of saturated $C_{16-20}$ fatty acids, without modifying or changing the oil composition.

SUMMARY

It was surprisingly found that the addition of a polyalkyl (meth)acrylate copolymer, as defined as polymer compound (C) in claim 1, provides improved low temperature storage stability of $C_{16-20}$ oil formulations comprising from 20% to 100% by weight, preferably from 20% to 80% by weight, more preferably from 20% to 65% by weight, even more preferably from 20% to 50% by weight of one or more of the $C_{16-20}$ saturated fatty acids, in particular low temperature storage stability of $C_{16-20}$ vegetable oil and animal oil formulations. Specifically, the oil will remain as a liquid for a longer time when exposed to lower temperatures compared to the untreated $C_{16-20}$ vegetable oils.

Thus, a first aspect of the invention is an oil formulation comprising one or more $C_{16-20}$ oils and a polymer compound (C) as defined in claim 1 and its dependent claims.

A second aspect of the invention is a method for manufacturing such an oil formulation.

A third aspect of the invention is the use of such a polymer compound (C) for the improvement of the low temperature storage stability of $C_{16-20}$ oil formulations comprising from 20% to 100% by weight, preferably from 20% to 80% by weight, more preferably from 20% to 65% by weight, even more preferably from 20% to 50% by weight of one or more of the $C_{16-20}$ saturated fatty acids.

DETAILED DESCRIPTION

Definitions

"Oils" as used here correspond to "nature-derived" oils, in the form of natural oils or animal oils. These "Oils" are triglycerides of saturated or unsaturated fatty acids as such or compositions obtained by mixing different triglycerides of saturated and/or unsaturated fatty acids. Such compositions contain as predominant components these triglycerides of saturated and/or unsaturated fatty acids. These "oils" may contain as minor components mono- and/or diglycerides, free fatty acids, phosphatides, sterols, fatty alcohols, fat-soluble vitamins, other substances, or mixtures thereof.

The major constituent of vegetable oils and animal oils is triglyceride, which is an ester, derived from glycerol and one or more free fatty acids. The number of carbon atoms and the amount of saturation and unsaturation in the fatty acid chain define the properties, such as low temperature behavior and oxidation stability of fats and oils. The number of carbon atoms in fatty acids found in plants and animals ranges from C6 to C30. The melting point of the fatty acids increases with an increasing number of carbon atoms in the fatty acid chain (molecular weight). The extent of saturation and unsaturation in the fatty acid chains of triglycerides can vary significantly depending upon the sources of oils and fats. The saturated fatty acids have a higher melting point as compared to an unsaturated fatty acid chain.

"Vegetable oils" are in general oils and fats extracted from the fruit and/or seeds of plants. The predominant components are triglycerides of saturated and/or unsaturated fatty acids. The minor components can include mono- and diglycerides, free fatty acids, phosphatides, sterols, fatty alcohols, fat-soluble vitamins, other substances, or mixtures thereof.

"Predominant components" means the sum of these components is 50% by weight or more. "Minor components" means the sum of these components is less than 50% by weight.

The Oil Formulation According to the Invention

The oil formulation according to the invention is characterized to comprise (A) one or more $C_{16-20}$ oils, wherein the one or more $C_{16-20}$ oil (A) comprises from 20% to 100% by weight, preferably from 20% to 80% by weight, more preferably from 20% to 65% by weight, even more preferably from 20% to 50% by weight of one or more of the saturated fatty acids selected from the list consisting of palmitic acid (C16:0), stearic acid (C18:0), eicosanoic acid (C20:0), based on the total weight of fatty acids in the $C_{16-20}$ oil (A); and (B) an additive composition comprising (C) one or more polymer compound, wherein the polymer compound (C) is obtainable by polymerizing a monomer composition comprising c1) 0% to 40% by weight of one or more alkyl (meth) acrylate monomer of formula (I):

(I)

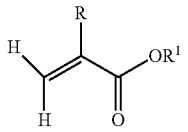

wherein R is hydrogen or methyl, $R^1$ means a linear, branched or cyclic alkyl residue with 1 to 8 carbon atoms, preferably 1 to 5 carbon atoms, and more preferably 1 to 3 carbon atoms, based on the total weight of the monomer composition, c2) 20% to 80% by weight of one or more alkyl (meth) acrylate monomer of formula (II):

(II)

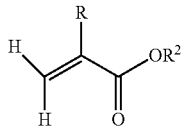

wherein R is hydrogen or methyl, $R^2$ means a linear, branched or cyclic alkyl residue with 9 to 15 carbon atoms, preferably 10 to 15 carbon atoms, and more preferably 12 to 15 carbon atoms, based on the total weight of the monomer composition, and c3) 20% to 80% by weight of one or more alkyl (meth) acrylate monomer of formula (III):

(III)

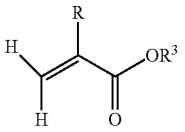

wherein R is hydrogen or methyl, $R^3$ means a linear, branched or cyclic alkyl residue with 16 to 40 carbon atoms, preferably 16 to 22 carbon atoms, and more preferably 16 to 20 carbon atoms, based on the total weight of the monomer composition.

According to a preferred embodiment of the invention, the additive composition (B) further comprises a base oil (D), different from the $C_{16-20}$ oil (A) and selected from the list consisting of an API Group I base oil, an API Group II base oil, an API Group III base oil, an API Group IV base oil and an API Group V base oil, or a mixture of one or more of these base oils.

According to an even more preferred embodiment of the invention, the base oil (D) is a vegetable oil, preferably a vegetable oil comprising less than 20% saturated C16 to C22 fatty acids and more than 70% unsaturated fatty acids. Even more preferably, the base oil (D) is canola oil.

According to the invention, the amount of the polymer compound (C) in the oil formulation preferably is in the range from 0.05 to 20% by weight, more preferably in the range from 0.1 to 10% by weight, based on the total oil formulation.

According to the invention the amount of the base oil (D) in the oil formulation preferably is in the range from 0.05 to 20% by weight, more preferably in the range from 0.1 to 10% by weight, based on the total oil formulation.

The Polymer Compound According to the Invention (Component (C))

With regard to monomer units c), the term (meth)acrylates includes methacrylates and acrylates as well as mixtures thereof. These monomers are well known in the art. The alkyl residue of the ester compounds can be linear, cyclic or branched. The monomers can be used individually or as mixtures of different alkyl (meth)acrylate monomers.

The term "$C_{1-40}$ alkyl (meth)acrylates" refers to esters of (meth)acrylic acid and straight chain, cyclic or branched alcohols having 1 to 40 carbon atoms. The term encompasses individual (meth)acrylic esters with an alcohol of a particular length, and likewise mixtures of (meth)acrylic esters with alcohols of different lengths.

As indicated above, according to the present invention, the polymer compound (C) is obtainable by polymerizing a monomer composition comprising:

c1) 0% to 40% by weight of one or more alkyl (meth) acrylate monomer of formula (I):

(I)

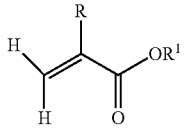

wherein R is hydrogen or methyl, $R^1$ means a linear, branched or cyclic alkyl residue with 1 to 8 carbon atoms, preferably 1 to 5 carbon atoms, and more preferably 1 to 3 carbon atoms, based on the total weight of the monomer composition, c2) 20% to 80% by weight of one or more alkyl (meth) acrylate monomer of formula (II):

(II)

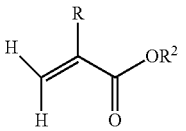

wherein R is hydrogen or methyl, $R^2$ means a linear, branched or cyclic alkyl residue with 9 to 15 carbon atoms, preferably 10 to 15 carbon atoms, and more preferably 12 to 15 carbon atoms, based on the total weight of the monomer composition, c3) 20% to 80% by weight of one or more alkyl (meth) acrylate monomer of formula (III):

(III)

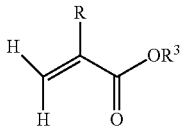

wherein R is hydrogen or methyl, $R^3$ means a linear, branched or cyclic alkyl residue with 16 to 40 carbon atoms, preferably 16 to 22 carbon atoms, and more preferably 16 to 20 carbon atoms, based on the total weight of the monomer composition.

The term "$C_{1-8}$ alkyl (meth)acrylates" refers to esters of (meth)acrylic acid and straight chain or branched alcohols having 1 to 8 carbon atoms. The term encompasses individual (meth)acrylic esters with an alcohol of a particular length, and likewise mixtures of (meth)acrylic esters with alcohols of different lengths. Examples of the one or more alkyl (meth)acrylate monomers c1) according to formula (I) are, among others, (meth)acrylates which derived from saturated alcohols such as methyl (meth)acrylate, ethyl (meth)acrylate, n-propyl (meth)acrylate, isopropyl (meth) acrylate, n-butyl (meth)acrylate, tert-butyl (meth)acrylate, pentyl (meth)acrylate and hexyl (meth)acrylate; cycloalkyl (meth)acrylates, like cyclopentyl (meth)acrylate, cyclohexyl (meth)acrylate, 2-ethylhexyl (meth)acrylate, heptyl (meth) acrylate, 2-tert-butylheptyl (meth)acrylate, n-octyl (meth) acrylate and 3-isopropylheptyl (meth)acrylate. Preferably, the polymer comprises units being derived from methyl methacrylate.

Particularly preferred $C_{1-8}$ alkyl (meth)acrylates are methyl (meth)acrylate and n-butyl (meth)acrylate.

The term "$C_{9-15}$ alkyl (meth)acrylates" refers to esters of (meth)acrylic acid and straight chain or branched alcohols having 9 to 15 carbon atoms. The term encompasses individual (meth)acrylic esters with an alcohol of a particular length, and likewise mixtures of (meth)acrylic esters with alcohols of different lengths. Examples of the one or more alkyl (meth)acrylate monomers c2) according to formula (II) include (meth)acrylates that derive from saturated alcohols, such as nonyl (meth)acrylate, decyl (meth)acrylate, isodecyl (meth)acrylate, undecyl (meth)acrylate, 5-methylundecyl (meth)acrylate, n-dodecyl (meth)acrylate, 2-methyldodecyl (meth)acrylate, tridecyl (meth)acrylate, 5-methyltridecyl (meth)acrylate, n-tetradecyl (meth)acrylate, pentadecyl (meth)acrylate; (meth)acrylates which derive from unsaturated alcohols, for example oleyl (meth)acrylate; cycloalkyl (meth)acrylates such as cyclohexyl (meth)acrylate having a ring substituent, like tert-butylcyclohexyl (meth)acrylate and trimethylcyclohexyl (meth)acrylate, bornyl (meth)acrylate and isobornyl (meth)acrylate.

Particularly preferred $C_{9-15}$ alkyl (meth)acrylates c2) are (meth)acrylic esters of a linear $C_{12-15}$ alcohol mixture ($C_{12-15}$ alkyl (meth)acrylate).

The term "$C_{16-40}$ alkyl (meth)acrylates" refers to esters of (meth)acrylic acid and straight chain or branched alcohols having 16 to 40 carbon atoms. The term encompasses individual (meth)acrylic esters with an alcohol of a particular length, and likewise mixtures of (meth)acrylic esters with alcohols of different lengths. Examples of the one or more alkyl (meth)acrylate monomers c3) of formula (III) include (meth)acrylates which derive from saturated alcohols, such as hexadecyl (meth)acrylate, 2-methylhexadecyl (meth) acrylate, heptadecyl (meth)acrylate, 5-isopropylheptadecyl (meth)acrylate, 4-tert-butyloctadecyl (meth)acrylate, 5-ethyloctadecyl (meth)acrylate, 3-isopropyloctadecyl (meth) acrylate, octadecyl (meth)acrylate, nonadecyl (meth)acrylate, eicosyl (meth)acrylate, cetyleicosyl (meth)acrylate, stearyleicosyl (meth)acrylate, docosyl (meth)acrylate, behenyl (meth)acrylate and/or eicosyltetratriacontyl (meth)acrylate.

Particularly preferred $C_{16-40}$ alkyl (meth)acrylates c3) are (meth)acrylic esters of a linear $C_{16-20}$ alcohol mixture ($C_{16-20}$ alkyl (meth)acrylate).

According to another preferred embodiment of the invention, the polymer compound (C) is obtainable by polymerizing a monomer composition comprising one or more alkyl (meth)acrylate monomer c2) and one or more alkyl (meth) acrylate monomer c3), wherein the alkyl group of each of the one or more alkyl (meth)acrylate monomer component c2) comprises from 10 to 15 carbon atoms, preferably from 12 to 15 carbon atoms, and wherein the alkyl group of each of the one or more alkyl (meth)acrylate monomer component c3) comprises from 16 to 22 carbon atoms, preferably from 16 to 20 carbon atoms.

According to an even more preferred embodiment of the invention, the polymer compound (C) is obtainable by polymerizing a monomer composition comprising one or more alkyl (meth)acrylate monomer c2) and one or more alkyl (meth)acrylate monomer c3), wherein the alkyl group of each of the one or more alkyl (meth)acrylate monomer component c2) comprises from 12 to 15 carbon atoms, and wherein the alkyl group of each of the one or more alkyl (meth)acrylate monomer component c3) comprises from 16 to 20 carbon atoms. Thus, preferably, the $C_{1-40}$ alkyl (meth) acrylates include a mixture of $C_{12-15}$ alkyl (meth)acrylates and $C_{16-20}$ alkyl (meth)acrylates.

The monomer composition to prepare the polymer compound (C) according to the present invention comprises 0% by weight to 40% by weight, preferably 0 to 30% by weight, preferably 0.1% by weight to 30% by weight, in particular 0.5% by weight to 20% by weight of the one or more alkyl (meth)acrylate monomer component c1), based on the total weight of the monomer composition.

The monomer composition to prepare the polymer compound (C) according to the present invention comprises from 20% by weight to 80% by weight, preferably from 30% by weight to 80% by weight, more preferably from 30% by weight to 70% by weight, even more preferably 35% by weight to 65% by weight, of the one or more alkyl (meth) acrylate monomer component c2), based on the total weight of the monomer composition.

The monomer composition to prepare the polymer compound (C) comprises from 20% by weight to 80% by weight, preferably from 20 to 70% by weight, more preferably from 30% by weight to 70% by weight, even more preferably from 35 to 65% by weight of the one or more alkyl (meth)acrylate monomer component c3), based on the total weight of the monomer composition.

Thus, according to a preferred embodiment of the invention, the monomer composition to prepare the polymer compound (C) comprises:

c1) 0 to 30% by weight, more preferably 0.1% to 30% by weight, even more preferably 0.5% to 20% by weight of the one or more alkyl (meth)acrylate monomer component c2), based on the total weight of the monomer composition, and c2) 30 to 80% by weight, more preferably from 30 to 70% by weight, even more preferably 35 to 65% by weight of the one or more alkyl (meth)acrylate monomer component c2), based on the total weight of the monomer composition, and c3) 20 to 70% by weight, more preferably from 30 to 70% by weight, even more preferably 35 to 65% by weight of the one or more alkyl (meth)acrylate monomer component c3), based on the total weight of the monomer composition.

According to another preferred embodiment of the invention, the monomer composition to prepare the polymer compound (C) comprises:

c2) from 20% by weight to 80% by weight, preferably from 30% by weight to 80% by weight, more preferably from 30% by weight to 70% by weight, even more preferably from 35 to 65% by weight of the one or more alkyl (meth)acrylate monomer component c2), based on the total weight of the monomer composition, and c3) from 20% by weight to 80% by weight, preferably from 20 to 70% by weight, more preferably from 30 to 70% by weight, even more preferably 35% to 65% by weight of the one or more alkyl (meth)acrylate monomer component c3), based on the total weight of the monomer composition.

Preferably, the amounts of components c1) to c3), or c2) and c3) indicated above to prepare the polymer (C) add up to 100% by weight.

According to a preferred embodiment of the invention, regarding the weight ratio of component c2) to component c3), this can be in the range of 0.1 to 10.0. In an even preferred embodiment of the invention the weight ratio of component c2) to component c3) is in the range of 0.2 to 6.0, more preferably in the range of 0.25 to 4.0, even more preferably in the range of 0.3 to 2.3, most preferably in the range of 0.4 to 1.5, or even most preferably in the range of 0.5 to 1.0.

Also, in a preferred embodiment, the polymer compound (C) has a weight average molecular weight (Mw) in the range of 20 to 200 kg/mol, preferably in the range of 20 to 120 kg/mol, more preferably in the range of 20 to 80 kg/mol.

In the present invention, the weight average molecular weights of the polymers were determined by gel permeation chromatography (GPC) using commercially available polymethylmethacrylate (PMMA) standards. The determination is effected by GPC with THF as eluent.

Additional Monomers

In another embodiment of the invention, the monomer composition to prepare the polymer (C) may comprise additional monomers in addition to the one or more alkyl (meth)acrylate monomer c1), c2) and c3).

These comonomers include hydroxyalkyl (meth)acrylates like 3-hydroxypropyl (meth)acrylate, 3,4-dihydroxybutyl (meth)acrylate, 2-hydroxyethyl (meth)acrylate, 2-hydroxypropyl (meth)acrylate, 2,5-dimethyl-1,6-hexanediol (meth) acrylate, 1,10-decanediol (meth)acrylate;

aminoalkyl (meth)acrylates and aminoalkyl (meth)acrylamides like N-(3-dimethyl-aminopropyl)methacrylamide, 3-diethylaminopentyl (meth)acrylate, 3-dibutyl-aminohexadecyl (meth)acrylate;

nitriles of (meth)acrylic acid and other nitrogen-containing (meth)acrylates like N-(methacryloyloxyethyl)diisobutylketimine, N-(methacryloyloxyethyl)dihexadecylketimine, (meth)acryloylamidoacetonitrile, 2-methacryloyloxyethylmethylcyanamide, cyanomethyl (meth)acrylate;

aryl (meth)acrylates like benzyl (meth)acrylate or phenyl (meth)acrylate, where the acryl residue in each case can be unsubstituted or substituted up to four times;

carbonyl-containing (meth)acrylates like 2-carboxyethyl (meth)acrylate, carboxymethyl (meth)acrylate, oxazolidinylethyl (meth)acrylate, N-methyacryloyloxy)formamide, acetonyl (meth)acrylate, N-methacryloylmorpholine, N-methacryloyl-2-pyrrolidinone, N-(2-methyacryloxyoxyethyl)-2-pyrrolidinone, N-(3-methacryloyloxypropyl)-2-pyrrolidinone, N-(2-methyacryloyloxypentadecyl(-2-pyrrolidinone, N-(3-methacryloyloxyheptadecyl-2-pyrrolidinone;

(meth)acrylates of ether alcohols like tetrahydrofurfuryl (meth)acrylate, methoxyethoxyethyl (meth)acrylate, 1-butoxypropyl (meth)acrylate, cyclohexyloxyethyl (meth)acrylate, propoxyethoxyethyl (meth)acrylate, benzyloxyethyl (meth)acrylate, furfuryl (meth)acrylate, 2-butoxyethyl (meth)acrylate, 2-ethoxy-2-ethoxyethyl (meth)acrylate, 2-methoxy-2-ethoxypropyl (meth)acrylate, ethoxylated (meth)acrylates, 1-ethoxybutyl (meth)acrylate, methoxyethyl (meth)acrylate, 2-ethoxy-2-ethoxy-2-ethoxyethyl (meth)acrylate, esters of (meth)acrylic acid and methoxy polyethylene glycols;

(meth)acrylates of halogenated alcohols like 2,3-dibromopropyl (meth)acrylate, 4-bromophenyl (meth)acrylate, 1,3-dichloro-2-propyl (meth)acrylate, 2-bromoethyl (meth) acrylate, 2-iodoethyl (meth)acrylate, chloromethyl (meth) acrylate;

oxiranyl (meth)acrylate like 2,3-epoxybutyl (meth)acrylate, 3,4-epoxybutyl (meth)acrylate, 10,11 epoxyundecyl (meth)

acrylate, 2,3-epoxycyclohexyl (meth)acrylate, oxiranyl (meth)acrylates such as 10,11-epoxyhexadecyl (meth)acrylate, glycidyl (meth)acrylate;

phosphorus-, boron- and/or silicon-containing (meth)acrylates like 2-(dimethyl-phosphato)propyl (meth)acrylate, 2-(ethylphosphito)propyl (meth)acrylate, 2-dimethylphosphinomethyl (meth)acrylate, dimethylphosphonoethyl (meth)acrylate, diethylmethacryloyl phosphonate, dipropylmethacryloyl phosphate, 2-(dibutylphosphono)ethyl (meth) acrylate, 2,3-butylenemethacryloylethyl borate, methyldiethoxymethacryloylethoxysiliane, diethylphosphatoethyl (meth)acrylate;

sulfur-containing (meth)acrylates like ethylsulfinylethyl (meth)acrylate, 4-thiocyanatobutyl (meth)acrylate, ethylsulfonylethyl (meth)acrylate, thiocyanatomethyl (meth) acrylate, methylsulfinylmethyl (meth)acrylate, bis(methacryloyloxyethyl) sulfide;

heterocyclic (meth)acrylates like 2-(1-imidazolyl)ethyl (meth)acrylate, 2-(4-morpholinyl)ethyl (meth)acrylate and 1-(2-methacryloyloxyethyl)-2-pyrrolidone;

maleic acid and maleic acid derivatives such as mono- and diesters of maleic acid, maleic anhydride, methylmaleic anhydride, maleinimide, methylmaleinimide;

fumaric acid and fumaric acid derivatives such as, for example, mono- and diesters of fumaric acid;

vinyl halides such as, for example, vinyl chloride, vinyl fluoride, vinylidene chloride and vinylidene fluoride;

vinyl esters like vinyl acetate;

vinyl monomers containing aromatic groups like styrene, substituted styrenes with an alkyl substituent in the side chain, such as alpha-methylstyrene and alpha-ethylstyrene, substituted styrenes with an alkyl substituent on the ring such as vinyltoluene and p-methylstyrene, halogenated styrenes such as monochlorostyrenes, dichlorostyrenes, tribromostyrenes and tetrabromostyrenes;

heterocyclic vinyl compounds like 2-vinylpyridine, 3-vinylpyridine, 2-methyl-5-vinylpyridine, 3-ethyl-4-vinylpyridine, 2,3-dimethyl-5-vinylpyridine, vinylpyrimidine, vinylpiperidine, 9-vinylcarbazole, 3-vinylcarbazole, 4-vinylcarbazole, 1-vinylimidazole, 2-methyl-1-vinylimidazole, N-vinylpyrrolidone, 2-vinylpyrrolidone, N-vinylpyrrolidine, 3-vinylpyrrolidine, N-vinylcaprolactam, N-vinylbutyrolactam, vinyloxolane, vinylfuran, vinylthiophene, vinylthiolane, vinylthiazoles and hydrogenated vinylthiazoles, vinyloxazoles and hydrogenated vinyloxazoles;

vinyl and isoprenyl ethers;

methacrylic acid and acrylic acid.

Preferably, when additional comonomers are used in the monomer composition to prepare the polymer (C), then the amounts of components c1) to c3) and comonomers used in the monomer composition to prepare the polymer (C) add up to 100% by weight.

Preparation of the Polymer Compound (C)

The polymers (C) can be obtained by free-radical polymerization and related processes, for example ATRP (Atom Transfer Radical Polymerization), RAFT (Reversible Addition Fragmentation Chain Transfer) or NMP processes (nitroxide-mediated polymerization). More preferably, the polymers of the invention are prepared by free-radical polymerization.

Customary free-radical polymerization is described, inter alia, in Ullmann's Encyclopedia of Industrial Chemistry, Sixth Edition. In general, a polymerization initiator is used for this purpose. The usable initiators include the azo initiators widely known in the technical field, such as 2,2'-azo-bis-isobutyronitrile (AIBN), 2,2'-azo-bis-(2-methylbutyronitrile) (AMBN) and 1,1-azobiscyclohexanecarbonitrile, and also peroxy compounds such as methyl ethyl ketone peroxide, acetylacetone peroxide, dilauryl peroxide, tert-butyl peroxypivalate, tert-butyl peroxy-2-ethylhexanoate, tert-amyl peroxy-2-ethylhexanoate, ketone peroxide, tert-butyl peroctoate, methyl isobutyl ketone peroxide, cyclohexanone peroxide, dibenzoyl peroxide, tert-butyl-peroxybenzoate, tert-butyl-peroxyisopropylcarbonate, 2,5-bis (2-ethylhexanoyl¬peroxy)-2,5-dimethylhexane, tert-butyl-peroxy-2-ethylhexanoate, tert-butyl-peroxy-3,5,5-trimethylhexanoate, dicumyl peroxide, 1,1-bis(tert-butyl-peroxy)cyclohexane, 1,1-bis(tert-butyl-peroxy)-3,3,5-trimethylcyclohexane, cumyl hydroperoxide, tert-butyl-hydroperoxide, bis(4-tert-butylcyclohexyl) peroxydicarbonate, mixtures of two or more of the aforementioned compounds with one another, and mixtures of the aforementioned compounds with compounds which have not been mentioned but can likewise form free radicals. Furthermore a chain transfer agents can be used.

It is well-known in the art that a good way to control the molecular weight of a polymer chain is to use chain transfer agents during the polymerization synthesis. Chain transfer agents are molecules with a weak chemical bond which facilities the chain transfer reaction. During the chain transfer reaction, the radical of the polymer chain abstracts a hydrogen from the chain transfer agent, resulting in the formation of a new radical on the sulfur atom of the chain transfer agent capable of further propagation. Common chain transfer agents are organic compounds comprising SH groups such as n-butyl mercaptan, n-octyl mercaptan, dodecyl mercaptan, tert-dodecyl mercaptan, dodecylmercaptan, butylthiol glycolate, and octylthiol glycolate.

Especially, the monomer mixture to prepare the polymer (C) of the present invention may comprise 0.05 to 15% by weight, preferably 0.05 to 5% by weight and more preferably 0.1 to 1% by weight of initiator based on the total weight of the monomer composition. The amount of chain transfer agents can be used in an amount of 0 to 5% by weight, preferably 0.01 to 3% by weight and more preferably 0.02 to 2% by weight based on the total weight of the monomer composition.

The polymerization may be carried out at standard pressure, reduced pressure or elevated pressure. The polymerization temperature is not critical. Conventionally the polymerization temperature may be in the range of 0° C. to 200° C., preferably 0° C. to 140° C., and more preferably 60° C. to 130° C.

The polymerization may be carried out with or without solvent. The term solvent is to be understood here in a broad sense.

The polymerization is preferably carried out in a nonpolar solvent. These include hydrocarbon solvents, for example aromatic solvents such as toluene, benzene and xylene, saturated hydrocarbons, for example cyclohexane, heptane, octane, nonane, decane, dodecane, which may also be present in branched form. These solvents may be used individually and as a mixture. Particularly preferred solvents are mineral oils, diesel fuels of mineral origin, naphthenic solvents, natural vegetable and animal oils, biodiesel fuels and synthetic oils (e.g. ester oils such as dinonyl adipate), and also mixtures thereof.

The $C_{16-20}$ Oils (Component (A))

According to the present invention, "$C_{16-20}$ oils" are oils rich in saturated and unsaturated $C_{16-20}$ fatty acid content.

According to the present invention, the fatty acid compositions, as described below, are expressed as a weight percentage of the total amount of fatty acids measured. The weight of glycerol is neglected. The short and designation for fatty acids consists of two numbers, the first being the number of carbon atoms and the second being the number of double bonds in the fatty acid chain. For example, stearic acid would be written C18:0.

According to the invention, the one or more $C_{16-20}$ oil (A) comprises from 20% to 100% by weight, preferably from 20% to 80% by weight, more preferably from 20% to 65% by weight, most preferably from 20% to 50% by weight of one or more of the fatty acids selected from the list consisting of palmitic acid (C16:0), stearic acid (C18:0), eicosanoic acid (C20:0), based on the total weight of fatty acids in the $C_{16-20}$ oil.

According to another preferred embodiment of the invention, the one or more $C_{16-20}$ oil (A) further comprises one or more of the fatty acids selected from the list consisting of unsaturated acid (C16:x), unsaturated acid (C18:x), unsaturated acid (C20:x), independently with x=1, 2, 3, 4, 5 or 6.

According to another preferred embodiment of the invention, the one or more $C_{16-20}$ oil (A)

comprises (i) from 20% to 80% by weight, preferably from 20% to 65% by weight, more preferably from 20% to 50% by weight of one or more of the fatty acids selected from the list consisting of palmitic acid (C16:0), stearic acid (C18:0), eicosanoic acid (C20:0), based on the total weight of the fatty acids of the $C_{16-20}$ vegetable oil (A), and (ii) from 20% to 80% by weight, preferably from 35% to 80% by weight, more preferably from 50% to 80% by weight of one or more of the fatty acids selected from the list consisting of unsaturated acid (C16:x), unsaturated acid (C18:x), unsaturated acid (C20:x), independently with x=1, 2, 3, 4, 5 or 6, preferably unsaturated acid (C18:1), based on the total weight of the fatty acids of the $C_{16-20}$ vegetable oil (A).

According to another preferred embodiment of the invention, the at least one or all of the one or more $C_{16-20}$ oil (A) is a $C_{16-20}$ vegetable oil, a $C_{16-20}$ animal oil such as a $C_{16-20}$ fish oil, or mixture thereof.

According to another preferred embodiment of the invention, the $C_{16-20}$ vegetable oil (A) comprises at least 5% by weight palmitic acid (C16:0), at least 15% by weight stearic acid (C18:0), at least 35% by weight unsaturated acid (C18:1), and at least 0.1% by weight eicosanoic acid (C20:0), preferably wherein the $C_{16-20}$ vegetable oil comprises at least 12% by weight palmitic acid (C16:0), at least 20% by weight stearic acid (C18:0), at least 45% by weight unsaturated acid (C18:1), and at least 0.3% by weight eicosanoic acid (C20:0), based on the total weight of the fatty acids of the $C_{16-20}$ oil (A).

The Base Oils (Component (D))

As indicated above, the additive composition (B) according to the invention optionally further comprises a base oil (D), which is different from the $C_{16-20}$ oil (A) and is selected from the list consisting of an API Group I base oil, an API Group II base oil, an API Group III base oil, an API Group IV base oil and an API Group V base oil, or a mixture of one or more of these base oils.

According to a preferred embodiment, the base oil (D) is a vegetable oil (API Group (V) base oil), preferably a vegetable oil comprising less than 20% saturated C16 to C22 fatty acids and more than 70% unsaturated fatty acids. More preferably, the vegetable oil is canola oil.

Typically, a canola oil has a fatty acid composition comprising 4 to 5% by weight of C16:0, 1.5 to 2.5% by weight of C18:0, 53 to 60% by weight of C18:1, 20 to 23% by weight of C18:2, and 9 to 12% by weight of C18:3, based on the total weight of the fatty acid composition. Thus, the total amount of saturated fatty acids in canola oil is less than 10% by weight.

The Preparation Process of the Oil Formulation of the Invention

Another aspect of the invention is a method for manufacturing an oil formulation, especially an oil formulation as described above. The inventive method comprises the steps of:

(a) providing one or more $C_{16-20}$ oils (A);

(b) providing an additive composition (B) comprising one or more polymer compound (C) and, optionally, a base oil (D); and (c) mixing the one or more $C_{16-20}$ oils (A) with the additive composition (B).

Preferable Oil Compositions

According to a preferred embodiment of the invention, the oil formulation comprises (A) one or more vegetable $C_{16-20}$ oils as defined above; and (B) an additive composition comprising (C) one or more polymer compound, wherein the polymer compound (C) is obtainable by polymerizing a monomer composition comprising c2) from 20% by weight to 80% by weight, more preferably from 30% by weight to 80% by weight, even more preferably from 30% by weight to 70% by weight, even more preferably from 35 to 65% by weight of the one or more alkyl (meth)acrylate monomer component c2), based on the total weight of the monomer composition, and c3) from 20% by weight to 80% by weight, preferably from 20 to 70% by weight, more preferably from 30 to 70% by weight, even more preferably 35% to 65% by weight of the one or more alkyl (meth)acrylate monomer component c3), based on the total weight of the monomer composition, and wherein the alkyl group of each of the one or more alkyl (meth)acrylate monomer component c2) comprises from 9 to 15 carbon atoms, preferably from 12 to 15 carbon atoms, and wherein the alkyl group of each of the one or more alkyl (meth)acrylate monomer component c3) comprises from 16 to 22 carbon atoms, preferably from 16 to 20 carbon atoms.

According to another preferred embodiment, the additive composition (B) comprises further a base oil (D) different from the $C_{16-20}$ oil (A), which is a vegetable oil, even more preferably canola oil.

More preferably, the amount of the base oil (D) in the oil formulation is in the range from 0.05 to 20% by weight, preferably in the range from 0.1 to 10% by weight, based on the total weight of the oil formulation.

According to a preferred embodiment, the amount of the polymer compound (C) in the oil formulation is in the range from 0.05 to 20% by weight, preferably in the range from 0.1 to 10% by weight, based on the total weight of the oil formulation.

Use of the Polymer Compound (C) According to the Invention

A further aspect of the invention is the use of the polymer compound (C) described herein obtainable by polymerizing a monomer composition comprising c1) 0% to 40% by weight of one or more alkyl (meth) acrylate monomer of formula (I):

(I)

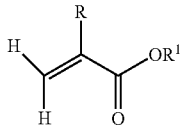

wherein R is hydrogen or methyl, $R^1$ means a linear, branched or cyclic alkyl residue with 1 to 8 carbon atoms, preferably 1 to 5 carbon atoms, and more preferably 1 to 3 carbon atoms, based on the total weight of the monomer composition, c2) 20% to 80% by weight of one or more alkyl (meth) acrylate monomer of formula (II):

(II)

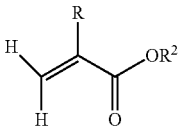

wherein R is hydrogen or methyl, $R^2$ means a linear, branched or cyclic alkyl residue with 9 to 15 carbon atoms, preferably 10 to 15 carbon atoms, and more preferably 12 to 15 carbon atoms, based on the total weight of the monomer composition, and c3) 20% to 80% by weight of one or more alkyl (meth) acrylate monomer of formula (III):

(III)

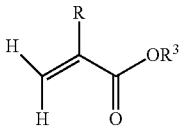

wherein R is hydrogen or methyl, $R^3$ means a linear, branched or cyclic alkyl residue with 16 to 40 carbon atoms, preferably 16 to 22 carbon atoms, and more preferably 16 to 20 carbon atoms, based on the total weight of the monomer composition, to improve the low temperature storage stability of $C_{16-20}$ oil formulations, wherein the $C_{16-20}$ oil comprises from 20% to 100% by weight, preferably from 20% to 80% by weight, more preferably from 20% to 65% by weight, even more preferably from 20% to 50% by weight of one or more of the saturated fatty acids selected from the list consisting of palmitic acid (C16:0), stearic acid (C18:0), eicosanoic acid (C20:0), based on the total weight of fatty acids in the $C_{16-20}$ oil (A). Again, the polymer compound (C) is obtainable as described above in detail.

Experimental Part

The invention is further illustrated in detail hereinafter with reference to examples and comparative examples, without any intention to limit the scope of the present invention.

Definitions and Abbreviations

The term "$C_{12-15}$ alkyl (meth)acrylates" refers to esters of (meth)acrylic acid and straight chain or branched alcohols having 12 to 15 carbon atoms. The term encompasses individual (meth)acrylic esters with an alcohol of a particular length, and likewise mixtures of (meth)acrylic esters with alcohols of different lengths.

The term "$C_{16-20}$ alkyl (meth)acrylates" refers to esters of (meth)acrylic acid and straight chain or branched alcohols having 16 to 20 carbon atoms. The term encompasses individual (meth)acrylic esters with an alcohol of a particular length, and likewise mixtures of (meth)acrylic esters with alcohols of different lengths.

"C6:0" is caproic acid/hexanoic acid

"C8:0" is caprylic acid/octanoic acid

"C10:0" is capric acid/decanoic acid

"C12:0" is lauric acid/dodecaonoic acid

"C14:0" is myristic acid/tetradecanoic acid

"C16:0" is palmitic acid/hexadecanoic acid

"C16:2" is 9,12-hexadecadienoic acid

"C16:3" is hexadecatrienoic

"C16:4" is 6,9,12,15-hexadecatetranoic acid

"C15:0" is pentadecanoic acid

"C18:0" is stearic acid/octadecanoic acid

"C18:1" can be oleioc acid/octadecenoic acid (the sum of cis- and trans-) or ricinoleic acid "C18:2" is linoleic acid (octadecadienoic acid)

"C18:3" is alpha-linolenic acid (octadecatrienoic acid)

"C18:4" is butyl 6,9,12,15-octadecatetraenoic acid

"C20:0" is eicosanoic acid/arachidic acid

"C20:1" is gondoic acid (cis-11-eicosenoic acid)

"C20:4" can be 5,8,11,14-eicosatetraenoic acid or methyl-8,11,14,17-eicosatetraenoic acid "C20:5" is 5,8,11,14,17-eicosapentaenoic acid or ethyl-6,9,12,15,18-heneicosapentaenoic acid "C22:0" is docosanoic acid/behenic acid "C22:5" is methyl-7,10,13,16,19-Docosapentaenoic acid "C22:6" is docosahexanoic acid "C24:0" is tetracosanoic acid/lignoceric acid

Test Methods

The polymer weight average molecular weights were measured by gel permeation chromatography (GPC) calibrated using poly(methyl-methacrylate) standards. Tetrahydrofuran (THF) is used as eluent.

The kinematic viscosities of the polymers were measured according to ASTM D445 with no deviations.

Low temperature storage stability test was carried out by first placing 15 mL of the example mixtures in a 25 mL capped glass vial. The vials were then placed in a laboratory freezer with a controlled temperature of 8° C. The samples were briefly removed from the freezer at 24 hours and 1 week given time intervals to check appearance and solidification.

Test Oils

Several test oils were purchased. Table 1 provides details on oil composition and basic characteristics. Four $C_{16-20}$ vegetable oils and one fish oil (animal oil) were obtained from different suppliers to show variability in different oils and to show robustness of the invention. Coconut oil 1 was used as a comparative example of a vegetable oil with low palmitic acid (C16:0), stearic acid (C18:0), and eicosanoic acid (C20:0) content.

TABLE 1

| Composition of $C_{16-20}$ oils, canola oil and coconut oil used for the tests | | |
|---|---|---|
| $C_{16-20}$ oils Code | Fatty Acid Composition | Content of palmitic acid (C16:0), stearic acid (C18:0), and eicosanoic acid (C20:0) in the tested oil |
| $C_{16-20}$ vegetable oil 1 | C16:0, 15.7% \| C18:0, 26.3% \| C18:1, 54.2% \| C20:0, 1% \| C22:0, 0.7%\| C24:0 0.6% | 42.1% |
| $C_{16-20}$ vegetable oil 2 | C16:0, 15.9% \| C18:0, 26.7% \| C18:1, 52.7% \| C20:0, 0.5% \| C22:0 0.3% \| C24:0 0.3% | 43.1% |
| $C_{16-20}$ vegetable oil 3 | C6:0, 0.2% \| C14:0, 0.1 \| C16:0, 34.1% \| C18:0, 1.9% \| C18:1, 61.7% \| C18:2, 1.3% \| 08:3, 0.4% \|C20:0, 0.2% | 36.2% |
| $C_{16-20}$ vegetable oil 4 | C12:0, 0.1% \| C14:0, 0.5% \| C16:0, 26.6% \| C18:0, 10.6% \| C18:1, 35.5% \| C18:2, 24.6% \| 08:3, 1.5% \| C20:0, 0.5% | 37.7% |
| $C_{16-20}$ fish oil 1 | C14:0, 8.4% \| C15:0, 0.6% \| C16:0, 18.8% \| C16:2, 1.2% \| C16:3, 1.5% \| C16:4, 1.9% \| C18:0, 3.9% \| C18:1, 12.2% \| C18:2, 1.22%\| C18:3, 1.1% \| C18:4, 2.6% \| C20:0, 1.7% \| C20:4, 2% \| C20:5, 18.5% \| C22:0, 1% \| C22:5, 2.3% \| C22:6, 12.3% | 24.4% |
| coconut oil 1 | C6:0, 0.7% \| C8:0, 8.4% \| C10:0, 6.6% \| C12:0, 49.3% \| C14:0, 18.2% \| C16:0, 8.0%\| C18:0, 2.9% \| C18:1, 4.9% \| C20:0, 0.8% | 11.7% |
| canola oil | C16:0, 4.5% \| C18:0, 2% \| C18:1, 56.5% \| C18:2, 21.5% \| C18:3, 10.5% | 6.5% |

Polymers

Several polymers were synthesized to demonstrate the effectiveness of the polymers in the vegetable oils and demonstrate the necessary polymeric composition. Detailed compositional information can be found in Table 2. Molecular weight and kinematic viscosity of the polymer product were measured and can be found in Table 3.

TABLE 2

| Polymer composition | | | |
|---|---|---|---|
| Polymer | $C_{12-15}$ methacrylate wt % | $C_{16-20}$ methacrylate wt % | Weight ratio between C12-15 to C16-20 |
| P1 | 65 | 35 | 1.86 |
| P2 | 55 | 45 | 1.22 |
| P3 | 45 | 55 | 0.82 |
| P4 | 35 | 65 | 0.54 |
| P5 | 25 | 75 | 0.33 |
| P6 | 85 | 15 | 5.67 |
| P7 | 94 | 6 | 15.67 |

TABLE 3

| Polymer properties | | |
|---|---|---|
| Polymer | Kinematic Viscosity at 100° C. cSt | Weight Average Molecular Weight kg/mol |
| P1 | 386 | 60 |
| P2 | 360 | 58 |
| P3 | 227 | 59 |
| P4 | 312 | 58 |
| P5 | 305 | 56 |

TABLE 3-continued

| Polymer properties | | |
|---|---|---|
| Polymer | Kinematic Viscosity at 100° C. cSt | Weight Average Molecular Weight kg/mol |
| P6 | 318 | 63 |
| P7 | 322 | 68 |

Polymers P1 to P5 corresponds to polymers (C) according to the invention, whereas polymer P6 and P7 do not fall within the definition of polymer (C) as defined in claim 1 because the monomer composition to prepare polymer P6 or P7 contains an amount of alkyl (meth)acrylate monomer c3) lower than 20% by weight based on the total weight of the monomer composition.

Polymer Preparation

Preparation of Polymer 1:

650 grams of $C_{12-15}$ alkyl (meth)acrylate, 350 grams of $C_{16-20}$ alkyl (meth)acrylate, and 6.2 grams of n-dodecyl mercaptan were charged into a 2 L 4-necked round bottom flask. The reaction mixture was stirred using a C-stirring rod, inerted with nitrogen, and heated to 120° C. One the reactor reached the set-point temperature, 2 grams of t-butylperoctoate were fed into the reactor using the following dosing profile: 0.2 grams in the first 30 minutes, 0.4 grams in the next 40 minutes, the set-point temperature was changed to 105° C. and the last 1.4 grams were dosed in the next 30 minutes. After the initiator dosing was completed, the reaction was allowed to continue stirring for 1 hour at 105° C. 579 grams of canola oil were added to reactor and allowed to mix for 30 minutes.

Polymers 2-7 were prepared in the same way as example 1, except that the weight ratio of monomers was changed according to table 2 and polymers P6 and P7 were diluted with 579 grams of 100N mineral base oil.

Formulations and Low Temperature Storage Stability

The polymers were blended into the different vegetable oils or animal oils at 5 wt % by simple mixing. Low temperature storage stability test was carried out by first placing 20 mL of the mixtures in a 25 mL capped glass vial. The vials were then placed in a laboratory freezer with a controlled temperature of 8° C. or the desired test temperature. The mixtures were held at this temperature until they solidified. In order to check stability over time, samples were briefly removed from the freezer at given time intervals to check appearance and whether they would still flow.

EXAMPLE PREPARATION

Example 1

10 grams blends of polymer P1 and 190 grams of $C_{16-20}$ vegetable oil 1 mixed using an overhead stirrer with cross impeller for 60 minutes at 60° C.

Examples 2-44 were prepared in the same way as example 1 except that the polymer and oil ratios were changed according to Tables 4-8.

TABLE 4

Formulation examples and results in $C_{16-20}$ vegetable oils

| Example #: | | Neat $C_{16-20}$ vegetable oil 1 | Neat $C_{16-20}$ vegetable oil 2 | Ex. 1 | Ex. 2 | Ex. 3 | Ex. 4 | Ex. 5 | Ex. 44 | Ex. 6 | Ex. 7 | Ex. 8 | Ex. 9 | Ex. 10 | Ex. 29 | Ex. 30 |
|---|---|---|---|---|---|---|---|---|---|---|---|---|---|---|---|---|
| Polymer P1 | [wt %] | | | 5 | | | | | | 5 | | | | | | |
| Polymer P2 | [wt %] | | | | 5 | | | | | | 5 | | | | | |
| Polymer P3 | [wt %] | | | | | 5 | | | 1 | | | 5 | | | | |
| Polymer P4 | [wt %] | | | | | | 5 | | | | | | 5 | | | |
| Polymer P5 | [wt %] | | | | | | | 5 | | | | | | 5 | | |
| Polymer P6* | [wt %] | | | | | | | | | | | | | | 5 | |
| Polymer P7* | [wt %] | | | | | | | | | | | | | | | 5 |
| $C_{16-20}$ vegetable oil 1 | [wt %] | 100 | | 95 | 95 | 95 | 95 | 95 | 99 | | | | | | | |
| $C_{16-20}$ vegetable oil 2 | [wt %] | | 100 | | | | | | | 95 | 95 | 95 | 95 | 95 | 95 | 95 |
| 8° C. | 1 day | Δ | x | ○ | ○ | ○ | ○ | ○ | ○ | x | ○ | ○ | ○ | ○ | x | x |
| storage | 2 days | Δ | x | ○ | ○ | ○ | ○ | Δ | ○ | x | x | ○ | ○ | Δ | x | x |
| stability | 3 days | Δ | x | ○ | ○ | ○ | ○ | Δ | Δ | x | x | ○ | ○ | x | x | x |
| | 7 days | x | x | x | ○ | ○ | ○ | Δ | Δ | x | x | x | ○ | x | x | x |

x - solid/does not flow/heavy crystallization

Δ - still flows/some viscosity increase or crystallization observed

○ - liquid, no signs of crystallization (*) comparative polymers P6 and P7

TABLE 5

Formulation examples and results in $C_{16-20}$ vegetable oils

| Example #: | | Neat $C_{16-20}$ vegetable oil 3 | Neat $C_{16-20}$ vegetable oil 4 | Ex. 11 | Ex. 12 | Ex. 13 | Ex. 14 | Ex. 15 | Ex. 31 | Ex. 32 | Ex. 16 | Ex. 17 | Ex. 18 | Ex. 19 | Ex. 20 | Ex. 33 | Ex. 34 |
|---|---|---|---|---|---|---|---|---|---|---|---|---|---|---|---|---|---|
| Polymer P1 | [wt %] | | | 5 | | | | | | | 5 | | | | | | |
| Polymer P2 | [wt %] | | | | 5 | | | | | | | 5 | | | | | |
| Polymer P3 | [wt %] | | | | | 5 | | | | | | | 5 | | | | |
| Polymer P4 | [wt %] | | | | | | 5 | | | | | | | 5 | | | |
| Polymer P5 | [wt %] | | | | | | | 5 | | | | | | | 5 | | |
| Polymer P6* | [wt %] | | | | | | | | 5 | | | | | | | 5 | |
| Polymer P7* | [wt %] | | | | | | | | | 5 | | | | | | | 5 |
| $C_{16-20}$ vegetable oil 3 | [wt %] | 100 | | 95 | 95 | 95 | 95 | 95 | 95 | 95 | | | | | | | |
| $C_{16-20}$ vegetable oil 4 | [wt %] | | 100 | | | | | | | | 95 | 95 | 95 | 95 | 95 | 95 | 95 |
| 6° C. | 1 day | x | x | ○ | ○ | ○ | ○ | ○ | x | x | Δ | Δ | Δ | ○ | Δ | x | x |
| storage | 2 days | x | x | x | ○ | ○ | ○ | ○ | x | x | x | x | x | ○ | x | x | x |
| stability | 3 days | x | x | x | ○ | ○ | ○ | ○ | x | x | x | x | x | ○ | x | x | x |

x - solid/does not flow/heavy crystallization

Δ - still flows/some viscosity increase or crystallization observed

○ - liquid, no signs of crystallization (*) comparative polymers P6 and P7

TABLE 6

Formulation examples and results in $C_{16-20}$ oils

| Example #: | | Neat $C_{16-20}$ fish oil 1 | Ex. 21 | Ex. 22 | Ex. 23 | Ex. 24 | Ex. 25 | Ex. 26 | Ex. 35 | Ex. 36 |
|---|---|---|---|---|---|---|---|---|---|---|
| Polymer P1 | [wt %] | | 5 | | | | | | | |
| Polymer P2 | [wt %] | | | 5 | | | | | | |
| Polymer P3 | [wt %] | | | | 5 | | | 2.5 | | |
| Polymer P4 | [wt %] | | | | | 5 | | | | |
| Polymer P5 | [wt %] | | | | | | 5 | | | |

TABLE 6-continued

Formulation examples and results in $C_{16-20}$ oils

| Example #: | | Neat $C_{16-20}$ fish oil 1 | Ex. 21 | Ex. 22 | Ex. 23 | Ex. 24 | Ex. 25 | Ex. 26 | Ex. 35 | Ex. 36 |
|---|---|---|---|---|---|---|---|---|---|---|
| Polymer P6* | [wt %] | | | | | | | | 5 | |
| Polymer P7* | [wt %] | | | | | | | | | 5 |
| $C_{16-20}$ fish oil 1 | [wt %] | 100 | 95 | 95 | 95 | 95 | 95 | 97.5 | 95 | 95 |
| 6° C. | 1 day | x | ○ | ○ | ○ | ○ | ○ | n.m. | x | x |
| storage stability | 2 days | x | Δ | ○ | ○ | ○ | ○ | n.m. | x | x |
| | 3 days | x | Δ | Δ | ○ | ○ | Δ | n.m. | x | x |
| 18° C. | 2 days | x | n.m. | n.m. | n.m. | n.m. | n.m. | ○ | n.m. | n.m. |
| Storage stability | 32 days | x | n.m. | n.m. | n.m. | n.m. | n.m. | ○ | n.m. | n.m. |
| | 33 days | x | n.m. | n.m. | n.m. | n.m. | n.m. | Δ | n.m. | n.m. |

x - solid/does not flow/heavy crystallization
Δ - still flows/some viscosity increase or crystallization observed
○ - liquid, no signs of crystallization
n.m. - not measured
(*) comparative polymers P6 and P7

20

TABLE 7

Formulation examples and results in canola oil

| Example #: | | neat canola oil | Ex. 37 | Ex. 38 | Ex. 39 | Ex. 40 | Ex. 41 | Ex. 42 | Ex. 43 |
|---|---|---|---|---|---|---|---|---|---|
| Polymer P1 | [wt %] | | 5 | | | | | | |
| Polymer P2 | [wt %] | | | 5 | | | | | |
| Polymer P3 | [wt %] | | | | 5 | | | | |
| Polymer P4 | [wt %] | | | | | 5 | | | |
| Polymer P5 | [wt %] | | | | | | 5 | | |
| Polymer P6* | [wt %] | | | | | | | 5 | |
| Polymer P7* | [wt %] | | | | | | | | 5 |
| canola oil 1 | [wt %] | 100 | 95 | 95 | 95 | 95 | 95 | 95 | 95 |
| −25° C. | 3 days | ○ | ○ | ○ | x | x | x | ○ | ○ |
| storage stability | 8 days | ○ | x | x | x | x | x | ○ | ○ |
| | 14 days | ○ | x | x | x | x | x | ○ | ○ |

x - solid/does not flow/heavy crystallization
Δ - still flows/some viscosity increase or crystallization observed
○ - liquid, no signs of crystallization
(*) comparative polymers P6 and P7

As shown in examples 37 to 41 of Table 7, no improvement in cold temperature storage stability is observed with the addition of a poly alkyl(meth)acrylate copolymer (C) according to the invention to a canola oil having less than 10% by weight of saturated fatty acids. In contrast, the addition of polymers P6 and P7 prepared with a monomer composition comprising less than 20% by weight of $C_{16-20}$ (meth)acrylate monomer in the polymer composition improves the cold temperature storage stability of canola oil (see examples 42 and 43 of Table 7).

Formulation in Coconut Oil

TABLE 8

Comparative Formulation examples in coconut oil

| Example #: | | Example 27 | Example 28 |
|---|---|---|---|
| Polymer P3 | [wt %] | | 5 |
| Coconut Oil 1 | [wt %] | 100 | 95 |
| 8° C. | 2 hours | x | x |
| storage stability | | | |

x - solid/does not flow/heavy crystallization
Δ - still flows/some viscosity increase or crystallization observed
○ - liquid, no signs of crystallization The 8° C. storage stability test was carried out on Examples 27 and 28. Both samples crystallized within 2 hours. Therefore, there was no improvement in cold temperature storage stability by adding polymer P3.

Discussion on the Results:

It was found that the addition of a polyalkyl(meth)acrylate copolymer containing 35-75% of $C_{16-20}$ (meth)acrylate monomer in the polymer composition can significantly extend the time that an oil stays liquid before it solidifies. In order for the polymer to provide improved cold storage stability, or stay liquid for a longer period of time, the oil must contain a certain amount of palmitic acid (C16:0) and/or stearic acid (C18:0) and/or eicosanoic acid (C20:0).

Addition and simple blending of a polymer with the oil is much simpler and cost effective compared to other techniques such as additional melting steps, solvent processing, and wax extraction. Furthermore, the reduction of additional processing steps means that major and minor components of the oil will remain unchanged. This is especially important in applications where natural ingredients are found in very small quantities and are important for the final application.

As shown in Tables 4 to 6, the blends of $C_{16-20}$ vegetable oils and polyalkyl(meth)acrylate polymers as defined in the present invention show a much improved low temperature storage stability compared to untreated $C_{16-20}$ vegetable oils. Even though the oils still become solid at the same temperature, the oils that have been blended with the polymers of the invention stay liquid for a longer time thus have a much improved low temperature storage stability. It has been thus surprisingly found that by treating $C_{16-20}$ vegetable oils with the polyalkyl(meth)acrylate polymers as defined in the present invention (component (C)), then the low temperature storage stability of the $C_{16-20}$ vegetable oils could be drastically improved.

$C_{16-20}$ vegetable oil 1 contains 42% and $C_{16-20}$ vegetable oil 2 contains 43% total of C16:0, C18:0, and C20:0, respectively. Poor cold storage stability at 8° C. is noticeable for C16-20 vegetable oil 1 and $C_{16-20}$ vegetable oil 2. After 24 hours, viscosity increase and crystallization is observed for $C_{16-20}$ vegetable oil 1. $C_{16-20}$ vegetable oil 2 is solid within 24 hours.

$C_{16-20}$ vegetable oil 3 contains 36.2% total of C16:0, C18:0, and C20:0. $C_{16-20}$ vegetable oil 4 contains 37.7% total of C16:0, C18:0, and C20:0. $C_{16-20}$ fish oil 1 contains 24.4% total of C16:0, C18:0, and C20:0. Poor cold storage stability was observed for neat samples of these $C_{16-20}$ vegetable oil 3, $C_{16-20}$ vegetable oil 4, and $C_{16-20}$ fish oil 1. When stored at 6° C., all oils were solid or heavily crystallized within 24 hours.

Examples 1 to 26 according to the present invention show that the addition of polymers P1-P5 can greatly improve the cold storage stability of these same oils. Results show that only a certain range of $C_{16-20}$ alkyl (meth)acrylate in the copolymer composition is effective in improving the cold storage stability of the $C_{16-20}$ vegetable or animal oils (in particular $C_{16-20}$ fish oil).

For example, the $C_{16-20}$ fish oil 1 was treated with 2.5 wt % of Polymer P3 and stored at 18° C. for 33 days before crystallization was observed. In contrast, the same $C_{16-20}$ fish oil without additive crystallizes in just 2 days (Example 26).

Polymer P1 contains 35% of $C_{16-20}$ alkyl (meth)acrylate. The mixture containing polymer P1 and $C_{16-20}$ vegetable oil 1 (Example 1) remains liquid for at least 3 days, which provides an improvement in comparison to the untreated $C_{16-20}$ vegetable oil 1, which crystallizes within 24 hours.

Polymer P5 contains 75% of $C_{16-20}$ alkyl (meth)acrylate. The mixture containing polymer P5 and $C_{16-20}$ vegetable oil 1 (Example 5) remains liquid for at least 1 day. The mixture containing polymer P5 and $C_{16-20}$ vegetable oil 2 (Example 10) still flows after 2 days, but crystallization is noticeable.

Polymer P2 (45% $C_{16-20}$ alkyl (meth)acrylate), Polymer P3 (55% $C_{16-20}$ methacrylate), Polymer P4 (65% $C_{16-20}$ alkyl (meth)acrylate) were able to extend the cold storage stability of the $C_{16-20}$ vegetable oils the longest. The mixture containing polymer P3 and $C_{16-20}$ vegetable oil 2 (Example 8) remains liquid for at least 3 days. The mixtures containing polymers P2-P4 and $C_{16-20}$ vegetable oil 1 (Examples 2-4) remain liquid at least 7 days. The mixture containing polymer P4 and $C_{16-20}$ vegetable oil 2 (Example 9) remains liquid for at least 7 days.

In contrast, the polymer P3 according to the invention was not useful to improve the cold storage stability of Coconut Oil 1, which contains 11.7% total of C16:0, C18:0, and C20:0 (see Table 8), thus below the required content of saturated fatty acids (see table 8). The polymers P1 to P5 according to the invention were also not useful to improve the cold storage stability of canola oil which contains less than 10% by weight saturated fatty acids (see table 7). As shown in Tables 4 to 6, when tested in $C_{16-20}$ vegetable oils as defined according to the invention, the comparative polymers P6 and P7 were not useful to improve the cold storage stability of the $C_{16-20}$ vegetable oils.

The above experimental results demonstrate that in order for the polymer to provide improved cold storage stability over the time, only a treatment with the additive composition (B) comprising one or more polymer (C) as defined in claim 1 does improve the cold storage stability of $C_{16-20}$ oils (A) oil containing a certain amount of palmitic acid (C16:0) and/or stearic acid (C18:0) and/or eicosanoic acid (C20:0).

The invention claimed is:

1. An oil formulation comprising $C_{16-20}$ oil and having improved storage stability, the $C_{16-20}$ oil formulation comprising (A) from 80% to 99%, based on the total oil formulation, of one or more $C_{16-20}$ oil (A), wherein the one or more $C_{16-20}$ oil (A) comprises from 20% to 100% by weight of one or more of the saturated fatty acids selected from the group consisting of palmitic acid (C16:0), stearic acid (C18:0), eicosanoic acid (C20:0), based on the total weight of fatty acids in the $C_{16-20}$ oil (A); and (B) from 1 to 20 wt %, based on the total oil formulation, of an additive composition comprising (C) one or more polymer compound (C), wherein the amount of the one or more polymer compound (C) in the $C_{16-20}$ oil formulation is from 0.1 to 10% by weight, based on the total weight of the oil formulation, and wherein the one or more polymer compound (C) is obtainable by polymerizing a monomer composition comprising c1) from 0% to 40% by weight of one or more alkyl (meth)acrylate monomer of formula (I):

(I)

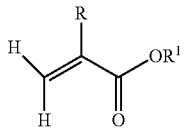

wherein R is hydrogen or methyl, $R^1$ means a linear, branched or cyclic alkyl residue with from 1 to 8 carbon atoms based on the total weight of the monomer composition, c2) from 20% to 80% by weight of one or more alkyl (meth)acrylate monomer of formula (II):

(II)

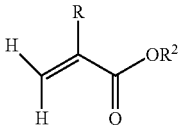

wherein R is hydrogen or methyl, R2 means a linear, branched or cyclic alkyl residue with 9 to 15 carbon atoms, based on the total weight of the monomer composition, and c3) from 35% to 80% by weight of one or more alkyl (meth)acrylate monomer of formula (III):

(III)

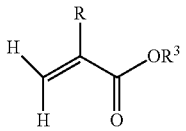

wherein R is hydrogen or methyl, $R^3$ means a linear, branched or cyclic alkyl residue with 16 to 40 carbon atoms, based on the total weight of the monomer composition, wherein the $C_{16-20}$ oil formulation has improved cold storage stability in that the oil formulation polymer remains a liquid and shows no signs of crystallization for 2 days of storage at 6° C.

2. The oil formulation according to claim 1, wherein c1) one or more alkyl (meth)acrylate monomer of formula (I) are methyl (meth)acrylate or n-butyl (meth)acrylate, c2) one or more alkyl (meth)acrylate monomer of formula (II) are (meth)acrylate esters of a linear $C_{12-13}$ alcohol mixture ($C_{12-13}$ alkyl (meth)acrylate), and c3) one or more alkyl (meth)acrylate monomer of formula (III) are (meth)acrylate esters of a linear $C_{16-20}$ alcohol mixture ($C_{16-20}$ alkyl (meth)acrylate).

3. The oil formulation according to claim 1, wherein the weight ratio of one or more alkyl (meth)acrylate monomer c2) to one or more alkyl (meth)acrylate monomer c3) is in the range of 0.1 to 10.0.

4. The oil formulation according to claim 1, wherein the additive composition (B) further comprises from 0.1 to 10% by weight of a base oil (D), which is different from the $C_{16-20}$ oil (A) and is selected from the group consisting of an API Group I base oil, an API Group II base oil, an API Group III base oil, an API Group IV base oil and an API Group V base oil or a mixture of one or more of these base oils.

5. The oil formulation according to claim 4, wherein the base oil (D) is a vegetable oil (D).

6. The oil formulation according to claim 1, wherein the one or more $C_{16-20}$ oil (A) further comprises one or more of the fatty acids selected from the group consisting of unsaturated acid (C16:x), unsaturated acid (C18:x), unsaturated acid (C20:x), independently with x=1, 2, 3, 4, 5 or 6 and wherein the additive composition (B) further comprises a vegetable oil comprising less than 20% saturated C16 to C22 fatty acids and more than 70% unsaturated fatty acids.

7. The oil formulation according to claim 1, wherein the one or more $C_{16-20}$ oil (A) comprises (i) from 20% to 80% by weight of one or more of the fatty acids selected from the group consisting of palmitic acid (C16:0), stearic acid (C18:0), eicosanoic acid (C20:0), based on the total weight of the fatty acids in the $C_{16-20}$ oil (A), and (ii) from 20% to 80% by weight of one or more of the fatty acids selected from the group consisting of unsaturated acid (C16:x), unsaturated acid (C18:x), unsaturated acid (C20:x), independently with x=1, 2, 3, 4, 5 or 6, preferably unsaturated acid (C18:1), based on the total weight of the fatty acids in the $C_{16-20}$ oil (A).

8. The oil formulation according to claim 1, wherein at least one or all of the one or more $C_{16-20}$ oil (A) is a $C_{16-20}$ vegetable oil or a $C_{16-20}$ animal oil and wherein the additive composition (B) further comprises from 0.05 to 20% by weight of canola oil.

9. The oil formulation according to claim 8, wherein the $C_{16-20}$ vegetable oil (A) comprises at least 5% by weight palmitic acid (C16:0), at least 15% by weight stearic acid (C18:0), at least 35% by weight unsaturated acid (C18:1), and at least 0.1% by weight eicosanoic acid (C20:0), wherein the $C_{16-20}$ vegetable oil comprises at least 12% by weight palmitic acid (C16:0), at least 20% by weight stearic acid (C18:0), at least 45% by weight unsaturated acid (C18:1), and at least 0.3% by weight eicosanoic acid (C20:0), based on the total weight of the fatty acids of the $C_{16-20}$ vegetable oil (A).

10. The oil formulation according to claim 1, wherein the polymer compound (C) has a weight average molecular weight in the range of from 20 to 200 kg/mol.

11. The oil formulation according to claim 1, wherein the amount of the base oil (D) in the oil formulation is in the range from 0.05 to 20% by weight based on the total weight of the oil formulation.

12. The oil formulation according to claim 1, wherein the amount of the polymer compound (C) in the oil formulation is in the range from 0.05 to 20% by weight based on the total weight of the oil formulation.

13. A method for manufacturing an oil formulation as defined in claim 1, the method comprising the steps of:

(a) providing one or more $C_{16-20}$ oils (A);

(b) providing an additive composition (B) comprising one or more polymer compound (C) and, optionally, a base oil (D); and (c) mixing the one or more $C_{16-20}$ oils (A) with the additive composition (B).

14. A composition comprising polymer compound (C) obtained by polymerizing a monomer composition comprising c1) from 0% to 40% by weight of one or more alkyl (meth)acrylate monomer of formula (I):

(I)

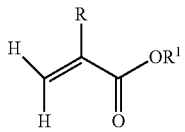

wherein R is hydrogen or methyl, $R^1$ means a linear, branched or cyclic alkyl residue with from 1 to 8 carbon atoms, based on the total weight of the monomer composition, c2) from 20% to 80% by weight of one or more alkyl (meth)acrylate monomer of formula (II):

(II)

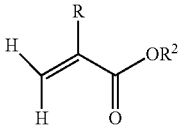

wherein R is hydrogen or methyl, $R^2$ means a linear, branched or cyclic alkyl residue with from 9 to 15 carbon atoms, based on the total weight of the monomer composition, and c3) from 35% to 80% by weight of one or more alkyl (meth)acrylate monomer of formula (III):

(III)

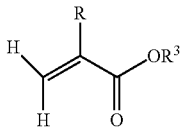

wherein R is hydrogen or methyl, $R^3$ means a linear, branched or cyclic alkyl residue with from 16 to 40 carbon atoms, based on the total weight of the monomer composition, to improve the low temperature storage stability of $C_{16-20}$ oil formulations comprising from 20% to 100% by weight of one or more of the saturated fatty acids selected from the group consisting of palmitic acid (C16:0), stearic acid (C18:0), eicosanoic acid (C20:0), based on the total weight of fatty acids in the $C_{16-20}$ oil (A).

15. The composition according to claim 14, wherein the monomer composition comprises c2) from 20% by weight to 80% by weight, of the one or more alkyl (meth)acrylate monomer component c2), based on the total weight of the monomer composition, and c3) from 35% by weight to 80% by weight, of the one or more alkyl (meth)acrylate monomer component c3), based on the total weight of the monomer composition.

16. The oil formulation according to claim 1, wherein the polymer compound (C) is obtained by polymerizing a monomer composition comprising c1) from 0% to 40% by weight of one or more alkyl (meth)acrylate monomer of formula (I):

(I)

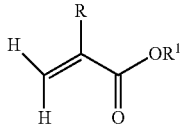

wherein R is hydrogen or methyl, $R^1$ means a linear, branched or cyclic alkyl residue with from 1 to 3 carbon atoms based on the total weight of the monomer composition, c2) from 20% to 80% by weight of one or more alkyl (meth)acrylate monomer of formula (II):

(II)

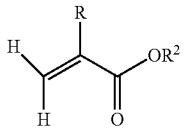

wherein R is hydrogen or methyl, $R^2$ means a linear, branched or cyclic alkyl residue with 12 to 15 carbon atoms based on the total weight of the monomer composition, and c3) from 35% to 80% by weight of one or more alkyl (meth)acrylate monomer of formula (III):

(III)

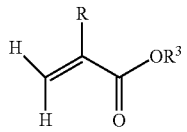

wherein R is hydrogen or methyl, $R^3$ means a linear, branched or cyclic alkyl residue with 16 to 20 carbon atoms based on the total weight of the monomer composition.

17. The oil formulation according to claim 1, wherein the polymer compound (C) is obtainable by polymerizing a monomer composition comprising c2) from 35% by weight to 65% by weight of the one or more alkyl (meth)acrylate monomer component c2), based on the total weight of the monomer composition, and c3) from 35% by weight to 65% by weight of the one or more alkyl (meth)acrylate monomer component c3), based on the total weight of the monomer composition.

18. The oil formulation according to claim 1, wherein the weight ratio of one or more alkyl (meth)acrylate monomer c2) to one or more alkyl (meth)acrylate monomer c3) is in the range of 0.5 to 1.0.

19. The oil formulation according to claim 4, wherein the base oil (D) is a vegetable oil (D) comprising less than 20% saturated C16 to C22 fatty acids and more than 70% unsaturated fatty acids.

20. The oil formulation according to claim 1, wherein the polymer compound (C) has a weight average molecular weight in the range of from 20 to 80 kg/mol.

21. The oil formulation according to claim 4, wherein the base oil (D) is canola oil.

* * * * *